US011578467B2

(12) United States Patent
McKenna et al.

(10) Patent No.: US 11,578,467 B2
(45) Date of Patent: Feb. 14, 2023

(54) VEHICLE BARRIER APPARATUS AND METHOD WITH TRANSFER FORCE DEPLOYMENT

(71) Applicant: Viken Detection Corporation, Burlington, MA (US)

(72) Inventors: Gill W. McKenna, Revere, MA (US); John P. Voccio, Newton, MA (US); Peter J. Rothschild, Newton, MA (US)

(73) Assignee: Viken Detection Corporation, Burlington, MA (US)

( * ) Notice: Subject to any disclaimer, the term of this patent is extended or adjusted under 35 U.S.C. 154(b) by 0 days.

(21) Appl. No.: 16/926,573

(22) Filed: Jul. 10, 2020

(65) Prior Publication Data

US 2021/0010216 A1 Jan. 14, 2021

Related U.S. Application Data

(60) Provisional application No. 62/872,562, filed on Jul. 10, 2019.

(51) Int. Cl.
*E01F 13/12* (2006.01)
*E01F 13/04* (2006.01)

(52) U.S. Cl.
CPC ..... *E01F 13/123* (2013.01); *E01F 13/044* (2013.01)

(58) Field of Classification Search
CPC ..... E01F 13/12; E01F 13/044
See application file for complete search history.

(56) References Cited

U.S. PATENT DOCUMENTS 3,389,677 A * 6/1968 Dunne ..... E01F 13/044 116/205
4,097,170 A 6/1978 Dickinson
(Continued)

FOREIGN PATENT DOCUMENTS

CN 201433364 Y 3/2010
CN 104947621 A 9/2015
(Continued)

OTHER PUBLICATIONS

Search Report and Written Opinion in International Application No. PCT/US2020/041723; "Vehicle Barrier With Transfer Force Deployment"; dated Oct. 26, 2020; (17 pages).
(Continued)

*Primary Examiner* — Thomas B Will
*Assistant Examiner* — Katherine J Chu
(74) *Attorney, Agent, or Firm* — Hamilton, Brook, Smith & Reynolds, P.C.

(57) ABSTRACT

A vehicle barrier apparatus and corresponding methods include a base and a vehicle receiving member coupled to the base and having proximal and distal ends. Also included is a deployable element rotatably coupled to the base and coupled to the vehicle receiving member at a mechanical coupler located closer to the distal end than to the proximal end. The deployable element is configured to receive a transfer force, from the vehicle receiving member, via the mechanical coupler, responsive to the vehicle receiving member receiving an applied force from a vehicle at the proximal end. The deployable element configured to deploy from a stored orientation to a deployed orientation responsive to the transfer force. Accordingly, vehicle force can be transferred and used to deploy the device effectively in a self-triggered configuration without hazards of stored energy.

23 Claims, 9 Drawing Sheets

(56) References Cited

U.S. PATENT DOCUMENTS

| | | | | |
|---|---|---|---|---|
| 4,367,975 | A | 1/1983 | Tyers | |
| 4,923,327 | A | 5/1990 | Gorlov | |
| 5,248,215 | A | 9/1993 | Fladung | |
| 5,267,808 | A | 12/1993 | Welford | |
| 5,288,164 | A | 2/1994 | Nasatka | |
| 5,486,065 | A * | 1/1996 | James | E01F 9/529 404/15 |
| 5,507,588 | A | 4/1996 | Marts et al. | |
| 5,509,753 | A | 4/1996 | Thompson | |
| 5,588,774 | A | 12/1996 | Behan | |
| 5,704,730 | A * | 1/1998 | Burton-Chambers | E01F 13/123 404/6 |
| 5,733,063 | A * | 3/1998 | Bailey | E01F 13/123 404/6 |
| 6,045,293 | A | 4/2000 | Dickinson | |
| 6,409,418 | B1 | 6/2002 | Blair et al. | |
| 6,435,762 | B1 * | 8/2002 | Markling | E01F 9/688 404/6 |
| 6,702,512 | B1 * | 3/2004 | Reale | E01F 13/123 404/6 |
| 7,011,470 | B1 | 3/2006 | Breazeale et al. | |
| 7,114,873 | B2 | 10/2006 | Rastegar et al. | |
| 7,494,112 | B2 * | 2/2009 | Fromm | E01F 13/12 256/64 |
| 7,645,090 | B2 | 1/2010 | Rastegar et al. | |
| 8,152,407 | B1 | 4/2012 | Al-Qahtani | |
| 8,215,866 | B2 | 7/2012 | Whitford | |
| 8,439,594 | B1 | 5/2013 | Clark et al. | |
| 8,439,595 | B1 | 5/2013 | Chaparro et al. | |
| 8,562,244 | B2 * | 10/2013 | D'Almeida | E01F 13/105 404/6 |
| 9,771,696 | B2 | 9/2017 | Neusch | |
| 9,951,487 | B1 | 4/2018 | Gonzalez | |
| 10,266,999 | B2 | 4/2019 | Rothschild | |
| 10,370,807 | B2 | 8/2019 | Stevens et al. | |
| 10,724,192 | B2 | 7/2020 | Rothschild et al. | |
| 10,837,149 | B2 * | 11/2020 | Klein | E01F 13/08 |
| 11,091,889 | B1 * | 8/2021 | Barrett | E01F 13/123 |
| 2005/0201827 | A1 | 9/2005 | Rastegar et al. | |
| 2006/0078378 | A1 | 4/2006 | Burns et al. | |
| 2006/0233607 | A1 | 10/2006 | Buckley et al. | |
| 2006/0233609 | A1 * | 10/2006 | Gelfand | E01F 13/08 404/6 |
| 2007/0048083 | A1 | 3/2007 | Burns et al. | |
| 2010/0290833 | A1 | 7/2010 | Whitford | |
| 2010/0196093 | A1 | 8/2010 | Seeglitz et al. | |
| 2011/0033233 | A1 * | 2/2011 | D'Almeida | E01F 13/105 404/6 |
| 2012/0282024 | A1 | 11/2012 | Hua | |
| 2013/0045047 | A1 | 2/2013 | Morgan et al. | |
| 2013/0209169 | A1 | 8/2013 | Chew et al. | |
| 2014/0227031 | A1 | 8/2014 | Fifi et al. | |
| 2014/0234024 | A1 | 8/2014 | Brackin et al. | |
| 2015/0252540 | A1 | 9/2015 | Lee | |
| 2016/0054102 | A1 | 2/2016 | Maydew | |
| 2016/0312416 | A1 | 10/2016 | Shi et al. | |
| 2017/0081814 | A1 | 3/2017 | Zwerneman | |
| 2017/0130411 | A1 | 5/2017 | Price | |
| 2018/0023263 | A1 | 1/2018 | Rothschild | |
| 2018/0135262 | A1 * | 5/2018 | Stevens | E01F 15/006 |
| 2019/0345682 | A1 | 11/2019 | Rothschild | |
| 2020/0393219 | A1 * | 12/2020 | Downing | E01F 13/02 |

FOREIGN PATENT DOCUMENTS

| | | | | |
|---|---|---|---|---|
| DE | 10057118 | A1 | 5/2002 | |
| DE | 102017002032 | A1 * | 9/2018 | E01F 13/12 |
| ES | 2538878 | A1 | 6/2015 | |
| FR | 2606049 | A1 | 5/1988 | |
| FR | 2627200 | A1 | 8/1989 | |
| FR | 2812311 | A1 * | 2/2002 | E01F 13/044 |
| FR | 2868445 | A1 * | 10/2005 | E01F 13/123 |
| GB | 2448324 | A * | 10/2008 | E01F 13/123 |
| JP | 4740383 | B1 * | 8/2011 | E01F 13/12 |
| KR | 20090036615 | A | 4/2009 | |
| WO | 1994/019544 | A1 | 9/1994 | |
| WO | 1995/030052 | A1 | 11/1995 | |
| WO | 2018018030 | A2 | 1/2018 | |
| WO | WO-2019170544 | A1 * | 9/2019 | E01F 13/123 |
| WO | 2021007567 | A1 | 1/2021 | |

OTHER PUBLICATIONS

International Search Report and Written Opinion for Int'l Application No. PCT/US2020/041723, titled: "Vehicle Barrier With Transfer Force Deployment," dated Oct. 26, 2020.

International Search Report and Written Opinion for Int'l Application No. PCT/US2017/043415, titled: "Self-Deploying Vehicle Intrustion Barrier," dated Jan. 29, 2018.

International Preliminary Report on Patentability for Int'l Application No. PCT/US2017/043415, titled: "Self-Deploying Vehicle Intrustion Barrier," dated Jan. 22, 2019.

Non-Final Office Action for U.S. Appl. No. 15/657,089, titled: "Self-Deploying Vehicle Intrustion Barrier," dated Apr. 30, 2018.

Non-Final Office Action for U.S. Appl. No. 16/354,704, titled: "Self-Deploying Vehicle Intrusion Barrier," dated Oct. 18, 2019.

Notice of Allowance for U.S. Appl. No. 15/657,089, titled: "Self-Deploying Vehicle Intrusion Barrier," dated Dec. 12, 2018.

Notice of Allowance for U.S. Appl. No. 16/354,704, titled: "Self-Deploying Vehicle Intrusion Barrier," dated Apr. 23, 2020.

Applicant Initiated Interview Summary for U.S. Appl. No. 15/657,089, titled: "Self-Deploying Vehicle Intrustion Barrier," dated Sep. 17, 2018.

International Preliminary Report on Patentability for International Application No. PCT/US2020/041723, entitled Vehicle Barrier With Transfer Force Deployment, dated Jan. 20, 2022.

* cited by examiner

VEHICLE BARRIER APPARATUS AND METHOD WITH TRANSFER FORCE DEPLOYMENT

RELATED APPLICATION(S)

This application claims the benefit of U.S. Provisional Application No. 62/872,562, filed on Jul. 10, 2019. This application is also related to U.S. Nonprovisional application Ser. No. 15/657,089, filed on Jul. 21, 2017. The entire teachings of both applications are incorporated herein by reference.

BACKGROUND

Security barriers may be installed around buildings, walkways, and other locations to prevent intrusion of vehicles that may pose a threat. Potential threats may include vehicles such as trucks laden with bombs or suicide bombers intending to attack security checkpoints, vehicles traveling at high rates of speed with an intent to cause injury to people or damage to property, and other vehicles being directed to targets for terrorist purposes. Existing vehicle barriers can include retractable metal spikes installed in pavement, large concrete blocks or stones placed around buildings, concrete barriers lifted into place by a crane and placed beside roadways and venues, and metal posts bored into sidewalks and streets.

SUMMARY

Existing barriers are inadequate to address today's terrorist threats and other security concerns. For example, at the 2016 Bastille Day event in Nice, France, a terrorist drove a large truck for over a mile through a crowded boardwalk, killing 84 people during the celebrations. Further attacks have taken place more recently in London, England. There have been more recent attacks using an SUV and a van in London, England, and similar attacks have taken place in Sweden and Germany. There is an urgent need for simple, low maintenance, easily deployable, and noninvasive barriers that can prevent vehicular access to certain areas in order to deter or prevent these tragedies.

Most intrusion barriers that are currently available do not self-deploy and tend to be devices that are designed to withstand tremendous forces in order to stop a vehicle. They are typically built into a roadway, for example. Extensive site modifications are typically required, limiting where and when the barriers can be installed. They tend to be intrusive and expensive, and they cannot be placed in venues of interest rapidly for special events or security situations.

It would be advantageous to provide a vehicle barrier apparatus that can be self-deploying, capable of impeding a vehicle at front wheels, and also not require stored energy for deployment. In contrast to existing vehicle barriers, embodiments described herein do not require any stored energy to deploy. Instead, disclosed embodiments can use the force of a vehicle itself impinging on an apparatus and can transfer a portion of that force via the apparatus to trigger deployment. In some embodiments, several rotatably-connected plates and struts are used to convert the weight and/or forward momentum of the vehicle to deploy the deployable element rapidly in order to stop or impede the vehicle. No energy is required to be stored in the apparatus, making it much safer than stored-energy systems, dramatically reducing potential consequences of a potential mechanical failure or accidental activation to people building, installing, or servicing the barrier, or to others who may be close to the apparatus. Also, embodiments do not require large forces to be applied at the factory to "prime" the apparatus and are not subject to degradation of springs or other activation mechanisms, which can compromise performance over time.

In one embodiment, a vehicle barrier apparatus includes a base; a vehicle receiving member coupled to the base and having proximal and distal ends; and a deployable element rotatably coupled to the base and coupled to the vehicle receiving member at a mechanical coupler located closer to the distal end than to the proximal end, the deployable element configured to receive a transfer force, from the vehicle receiving member, via the mechanical coupler, responsive to the vehicle receiving member's receiving an applied force from a vehicle at the proximal end, the deployable element configured to deploy from a stored orientation to a deployed orientation responsive to the transfer force.

The vehicle receiving member may be coupled to the base rotationally, translationally, or a combination of rotationally and translationally.

The vehicle receiving member can be a first vehicle receiving member, the apparatus further including a second vehicle receiving member rotatably coupled to the base and having proximal and distal ends, the proximal end of the second vehicle receiving member being coupled via a hinged coupler to the proximal end of the first vehicle receiving member, and the first vehicle receiving member being configured to receive the applied force at the proximal end thereof via the hinged coupler responsive to the vehicle's contacting the second vehicle receiving member.

The hinged coupler can be a hinge rod, and the base can define a vertical slot configured to accommodate a downward sliding of the hinge rod therein in response to the applied force.

The deployable element can be a first deployable element and the mechanical coupler can be a first mechanical coupler, and the apparatus further include a second deployable element rotatably coupled to the base and coupled to the second vehicle receiving member at a second mechanical coupler located closer to the distal end thereof than to the proximal end thereof. The second deployable element can be configured to receive a transfer force, from the second vehicle receiving member, via the second mechanical coupler, responsive to the second vehicle receiving member receiving the applied force from the vehicle at the proximal end thereof. The second deployable element can be configured to deploy from a stored orientation to a deployed orientation responsive to the transfer force. The first and second deployable elements can be configured to deploy with rotations about the base in mutually opposing rotational directions.

The mechanical coupler can include a slide rod extending from the deployable element and into a slot defined by the vehicle receiving member. The slide rod can be configured to slide within the slot as the vehicle receiving member applies the transfer force to the deployable element.

The apparatus can further include a triggering mechanism mechanically connected directly or indirectly to the vehicle receiving member. The triggering mechanism can be configured to permit deployment of the deployable element in response to the applied force from the vehicle and to prevent deployment of the deployable element in response to a force lesser in magnitude than the applied force from the vehicle.

The triggering mechanism can include a shearing mechanism configured to be sheared responsive to the applied force from the vehicle.

In the stored orientation, in profile, the deployable element can fit within the base or within the vehicle receiving element.

The apparatus can be a first vehicle barrier apparatus, and the base can include one or more attachment features facilitating attachment of the base of the first vehicle barrier apparatus to one or more corresponding bases of one or more respective second vehicle barrier apparatuses.

In another embodiment, a method of impeding motion of a vehicle includes transferring an applied force, imparted by a vehicle at a proximal end of a vehicle receiving member rotatably coupled to a base, to a deployable element as a transfer force from the vehicle receiving member. The transferring of the applied force as the transfer force occurs via a mechanical coupler rotatably coupling the deployable element to the vehicle receiving member at a location that is closer to a distal end of the vehicle receiving member than to the proximal end. The method further includes deploying the deployable element from a stored orientation to a deployed orientation responsive to the transfer force.

In yet another embodiment, a vehicle barrier apparatus includes means for transferring an applied force, imparted by a vehicle at a proximal end of a vehicle receiving member rotatably coupled to a base, to a deployable element as a transfer force from the vehicle receiving member. The transferring of the applied force as the transfer force occurs via a mechanical coupler rotatably coupling the deployable element to the vehicle receiving member at a location that is closer to a distal end of the vehicle receiving member than to the proximal end. The apparatus also includes means for deploying the deployable element from a stored orientation to a deployed orientation responsive to the transfer force.

In still another embodiment, a method of manufacturing a vehicle barrier apparatus includes assembling, into an assembled arrangement, a vehicle receiving member with a base, the vehicle receiving member having proximal and distal ends and rotatably coupled to the base at a location between the proximal and distal ends. The method also includes assembling a deployable element with the base, the deployable element, in an assembled arrangement, rotatably coupled to the base and arranged to receive a transfer force, from the vehicle receiving member, via a mechanical coupler that couples the deployable element to the vehicle receiving member at a location closer to the distal end than to the proximal end, responsive to the vehicle receiving member receiving an applied force from the vehicle at the proximal end, with the deployable element further arranged to deploy from a stored orientation to a deployed orientation responsive to the transfer force.

In yet another embodiment, a vehicle barrier apparatus includes a base and a vehicle receiving member. The vehicle receiving member has proximal and distal ends, and the vehicle receiving member is rotatably coupled to the base via a rotational coupling positioned between the proximal and distal ends. The apparatus also includes a deployable element rotatably coupled to the base to enable a transition from a stored orientation to a deployed orientation, the deployable element being configured in the deployed orientation to engage a vehicle physically. The vehicle receiving member is configured to rotate in response to an applied force from the vehicle at the proximal end thereof, with a rotation about the rotational coupling, the rotation comprising a downward motion of the proximal end and an upward motion of the distal end, the upward motion mechanically forcing the deployable element from the stored orientation to the deployed orientation.

The vehicle receiving member may be a first vehicle receiving member, the apparatus further including a second vehicle receiving member rotatably coupled to the base and having proximal and distal ends, the proximal end of the second vehicle receiving member being coupled via a hinged coupler to the proximal end of the first vehicle receiving member, and the first vehicle receiving member being configured to receive the applied force at the proximal end thereof via the hinged coupler responsive to the vehicle contacting the second vehicle receiving member.

The hinged coupler may include a hinge rod, and the base can define a vertical slot configured to accommodate a downward sliding of the hinge rod therein in response to the applied force.

The deployable element can be a first deployable element, and the apparatus can further include a second deployable element rotatably coupled to the base to enable a transition from a stored orientation to a deployed orientation, the second deployable element being configured in the deployed orientation to engage a vehicle physically. The second vehicle receiving member is configured to rotate in response to the applied force from the vehicle at the proximal end thereof, with a rotation comprising a downward motion of the proximal end thereof and an upward motion of the distal end thereof, the upward motion mechanically forcing the second deployable element from the stored orientation to the deployed orientation. The first and second deployable elements can be configured to deploy with rotations about the base in mutually opposing rotational directions.

The apparatus can further include a mechanical coupler that includes a slide rod extending from the deployable element and into a slot defined by the vehicle receiving member, the slide rod configured to slide within the slot as the vehicle receiving member rotates with the upward motion of the distal end thereof.

The apparatus can further include a triggering mechanism mechanically connected directly or indirectly to the vehicle receiving member. The triggering mechanism can be configured to permit deployment of the deployable element in response to the applied force from the vehicle and to prevent deployment of the deployable element in response to a force lesser in magnitude than the applied force from the vehicle. The triggering mechanism can include a shearing mechanism configured to be sheared responsive to the applied force from the vehicle.

The deployable element can fit within the base or within the vehicle receiving element in profile in the stored orientation.

The apparatus can be a first vehicle barrier apparatus, and the base can include one or more attachment features facilitating attachment of the base of the first vehicle barrier apparatus to one or more corresponding bases of one or more respective second vehicle barrier apparatuses.

Figure 1:
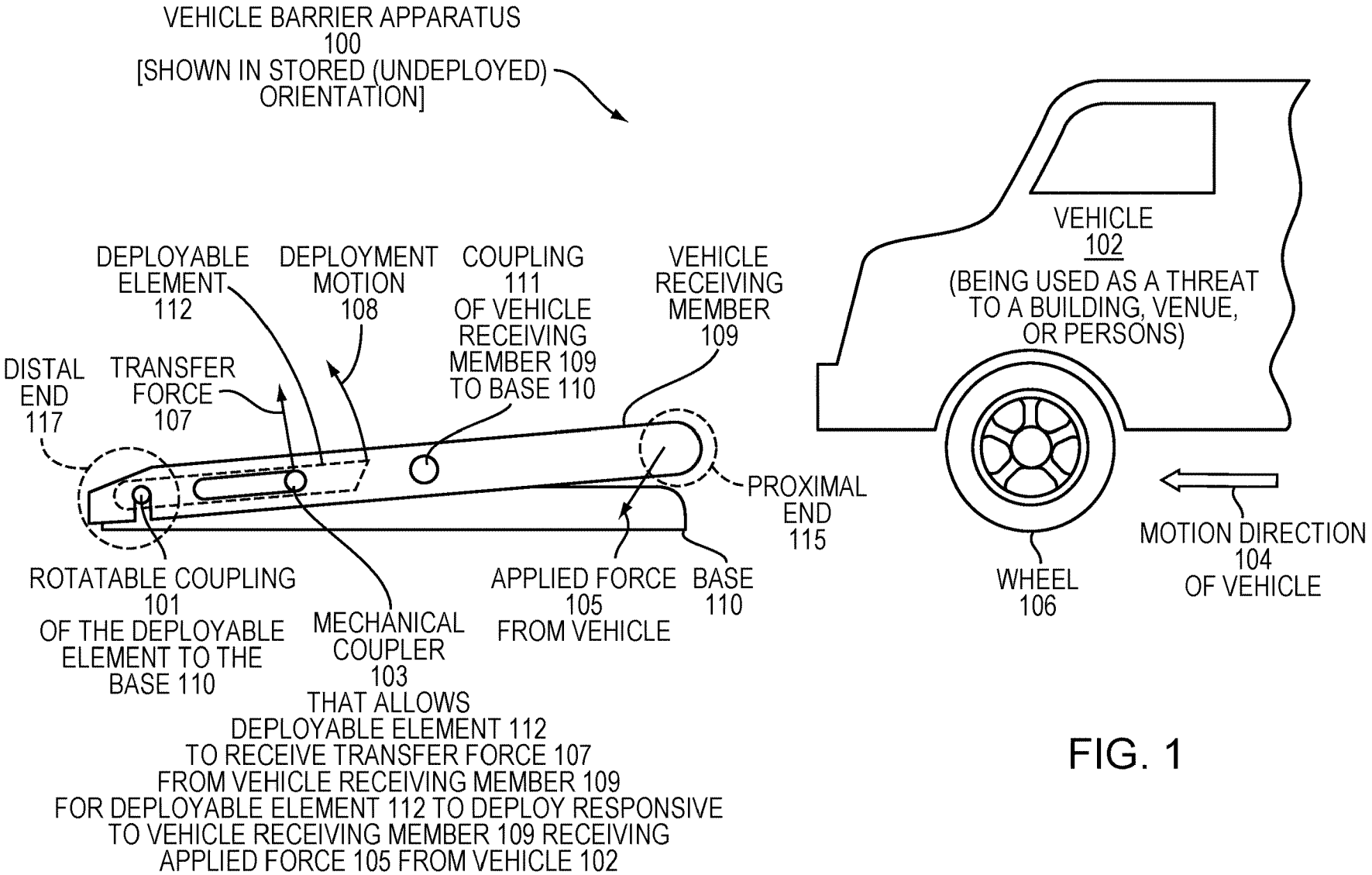
FIG. 1 is a profile-view diagram illustrating an embodiment vehicle barrier apparatus in a stored (undeployed) orientation, with a vehicle about to impinge on the apparatus.

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

FIG. 1 is a profile-view schematic diagram of an embodiment vehicle barrier apparatus 100. The apparatus 100 is shown in a stored (undeployed) orientation and is a generalized embodiment intended to illustrate general features that apply to many of the embodiments described herein. A vehicle 102, which is being used as a threat to a building, venue, or persons, for example, may move in a motion direction 104, and the apparatus 100 may engage the wheel 106 or another portion of the vehicle 102 to stop or impede the motion of the vehicle. The configuration of the apparatus 100 is as follows.

The apparatus 100 includes a base 110, to which other portions of the apparatus may be secured. In some embodiments, the base 110 includes a bottom plate-like structure that lies on the ground, with sidewalls that can also be plate-like and that can be used to secure other portions of the apparatus 100. However, in some embodiments, the base can be formed from two or more bars, such as metal bars, for example, or take other forms.

Figure 6:
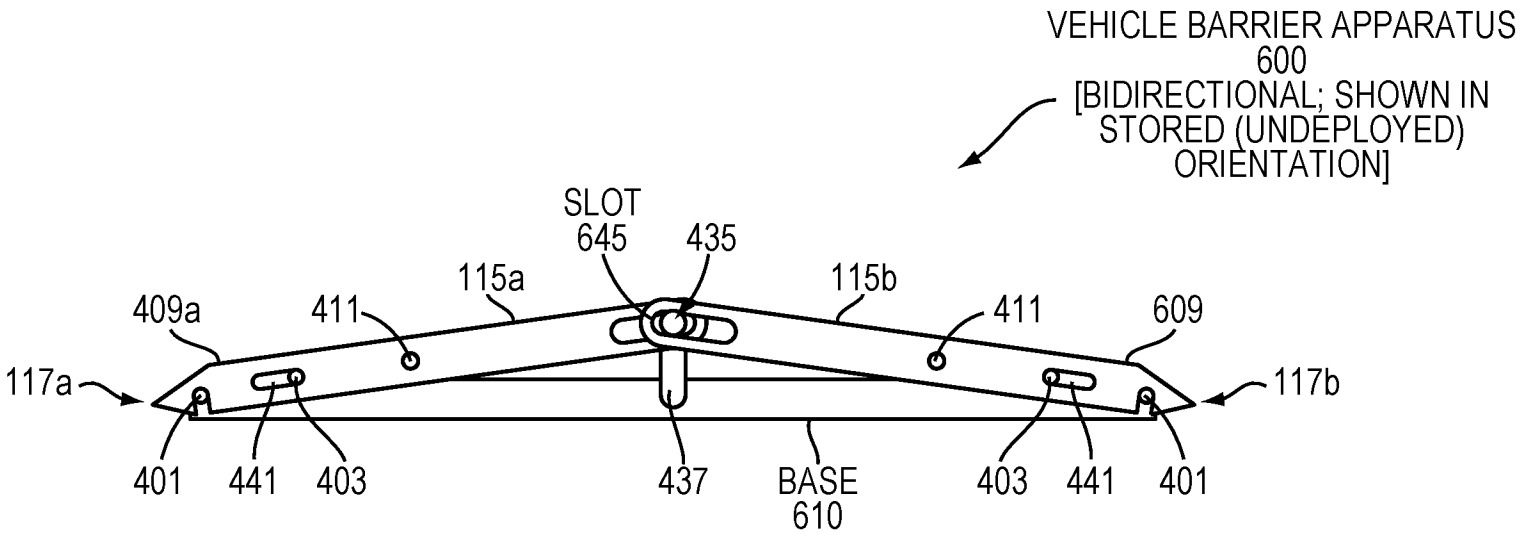
FIG. 6 is a profile-view illustration of an alternative vehicle barrier apparatus that is bidirectional, shown in an undeployed orientation.
Figure 7:
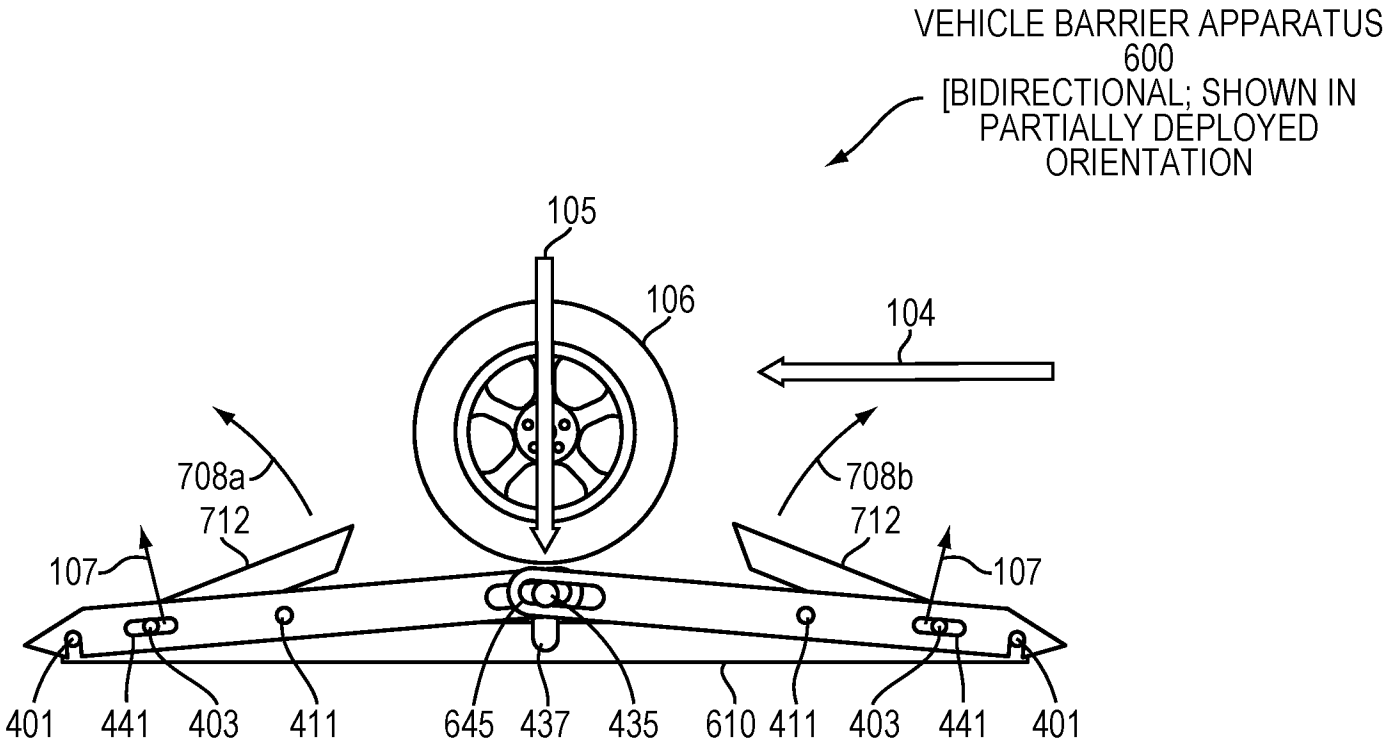
FIG. 7 is a profile-view illustration of the vehicle barrier apparatus of FIG. 6, shown in a partially deployed orientation.

The apparatus 100 also includes a vehicle receiving member 109, which has a proximal end 115 and a distal end 117. The apparatus 100 is configured principally to be a unidirectional vehicle barrier apparatus and is designed primarily to impede motion of the vehicle 102 when the vehicle 102 is incident at the proximal end 115 of the vehicle receiving member 109. Other embodiments described herein, such as those described in connection with FIGS. 6-7, are bidirectional and are configured to impede motion of the vehicle 102 whether the vehicle impinges on the device from the proximal end or from the distal end of the vehicle receiving member. Moreover, certain embodiments, such as those described in connection with FIGS. 4-5, even while being unidirectional, include a second vehicle receiving member that can act as a ramp for the vehicle wheel 106 and can assist the vehicle receiving member 109 to receive applied force from the vehicle, which can be used for deployment of the apparatus, as will be described hereinafter.

The vehicle receiving member 109 is coupled to the base 110 by means of a coupling 111. In some embodiments, such as those described in connection with FIGS. 2 and 4-7, the coupling 111 is a rotational coupling, such that the vehicle receiving member 109 is fixed translationally with respect to the base 110 at the coupling, yet can rotate with respect to the base 110 about the coupling. However, in other embodiments, such as the embodiment of FIG. 3, the coupling 111 is not a rotational coupling, but instead a translational coupling providing only translation of the vehicle receiving member with respect to the base. In yet other embodiments, a coupling may provide for a combination of translation and rotation with respect to the base. For example, in the embodiment described hereinafter in connection with FIG. 3, the coupling 111 is a slide rod, and the vehicle receiving member is configured to slide with respect to the base in order to provide a transfer force 107 for deployment. Thus, the coupling in FIG. 3 is a primarily a translational coupling between the vehicle receiving member and the base. As used herein, a coupling between a vehicle receiving member and a base may be considered a "rotational" coupling if it permits any degree of rotation of the vehicle receiving element with respect to the base, about the coupling, wherein the degree of rotation functions to facilitate a deployment of the apparatus. Moreover, in view of the description herein, persons of ordinary skill in the mechanical arts will understand that the coupling 111 can be of other types, in various positions on the apparatus, that will permit the vehicle receiving member 109 to provide a transfer force to a deployable element in response to the vehicle receiving member 109 receiving an applied force 105 from the vehicle 102.

The apparatus 100 further includes a deployable element 112 that is rotatably coupled to the base 110. The deployable element 112 is also coupled to the vehicle receiving member 109 at a mechanical coupler 103. The mechanical coupler 103 is located closer to the distal end 117 of the vehicle receiving member 109 than to the proximal end. The deployable element 112 is configured to receive the transfer force 107, from the vehicle receiving member 109, via the mechanical coupler 103, responsive to the vehicle receiving member 109 receiving the applied force 105 from the vehicle at the proximal end 115 thereof. The deployable element 112 is configured to deploy from a stored orientation, as illustrated in FIG. 1, to a deployed orientation (not illustrated in FIG. 1) responsive to the transfer force 107.

Figure 5:
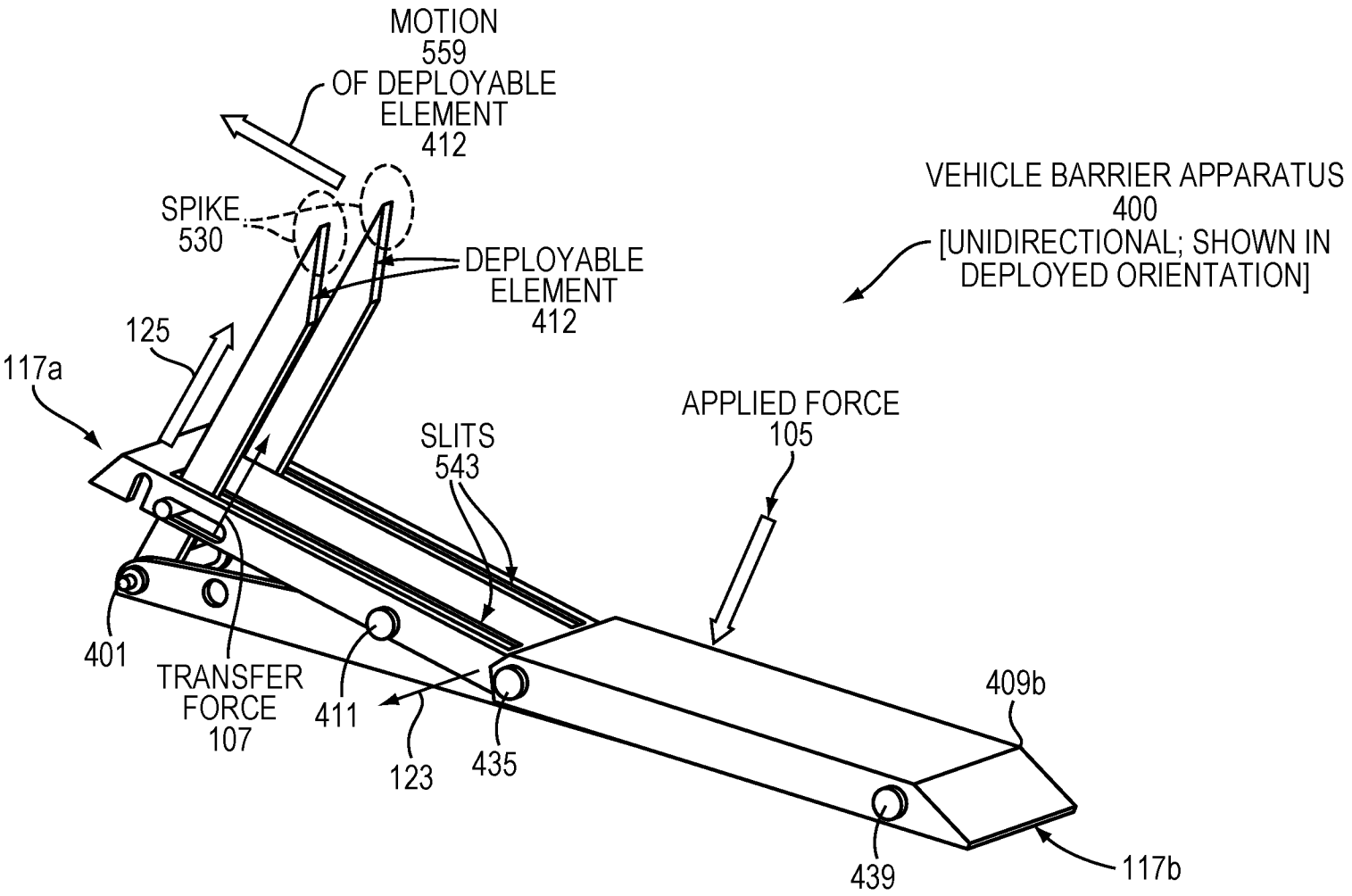
FIG. 5 is a perspective-view illustration of the vehicle barrier apparatus of FIG. 4 in a deployed orientation.

Deployed orientations of the apparatus 100 and similar embodiments will be understood more fully by reference to FIGS. 5 and 7, for example.

In some embodiments, such as those described in connection with FIGS. 3-7, the mechanical coupler 103 is a slide rod that extends from the deployable element 112 through a slot in the vehicle receiving member 109. However, in view of this specification, persons of ordinary skill in the mechanical arts will understand that this coupler may take other forms that allow the vehicle receiving member 109 to transfer the force 107 to the deployable element 112 to cause the deployment. The mechanical coupler 103 allows the deployable element 112 to receive the transfer force 107 from the vehicle receiving member 109, such that the deployable element 112 can deploy a with a deployment motion 108 responsive to the vehicle receiving member 109 receiving the applied force 105 from the vehicle 102. The deployable element 112 is rotatably coupled to the base 110 via a rotatable coupling 101. The rotatable coupling 101 may be, for example, a pivot axle that extends through both the deployable element 112 and the base 110, for example.

It should be understood that the applied force 105 from the vehicle can have various directional components, depending on the speed of the vehicle 102, the trajectory, the size of the tire, the height of the proximal end 115 above the ground, and various other factors. Nonetheless, it should be understood that the applied force 105 has a tendency either to push the vehicle receiving member from the proximal end toward the direction of the distal end, or to force the proximal end 115 down toward the ground and toward the base 110. In embodiments wherein the coupling 111 is a rotational coupling, such as a pivot pin through the vehicle receiving member 109 and through the base 110, the net result of the applied force 105 from the vehicle will be to push the proximal end 115 down toward the base 110 and toward the ground, resulting in the distal end 117 moving upward (generally away from the base 110 and away from the ground on which the base 110 rests). On the other hand, in other embodiments, such as that illustrated in FIG. 3, wherein the coupling 111 is not a rotational coupling, the net result of the applied force 105 from the vehicle can initially be to cause the vehicle receiving member 109 to slide with respect to the base 110.

It should be understood that "vehicle receiving member," as used herein, denotes a mechanical member that is configured with respect to the apparatus 100 and base 110 in order to allow the vehicle 102 to impinge thereon and to apply the force 105 from the vehicle. It should be understood that in some embodiments, such as the embodiment of FIG. 1, the first point of contact of the vehicle 102 with the apparatus 100 is at the proximal end 115 of the vehicle receiving member 109. In other embodiments, such as that illustrated in FIGS. 4-5, the proximal end 115 of the vehicle receiving member 109 may initially receive applied force 105 from the vehicle 102 indirectly, via the vehicle 102 initially pressing down on or striking a second vehicle receiving member that forms a ramp and is hingedly coupled with the first vehicle receiving member 109.

In some embodiments, the vehicle receiving number 109 is a plate-like structure with one or more slits that accommodate the deployable element 112 to be stored therein in the undeployed orientation, as illustrated in FIG. 1. In the stored, undeployed orientation, as can be seen in the profile view of FIG. 1, the deployable element 112 sits within the vehicle receiving element 109 in the profile. In alternative embodiments, the deployable element 112 may fit within the base 110. While it is not required for the deployable element 112 to fit inside the apparatus 100 completely in the stored orientation, such an arrangement is advantageous because it allows for the possibility for people or objects to pass over the apparatus 100, without interference from the deployable element 112, when the apparatus 100 is in the stored orientation. Only a vehicle or other very heavy object may be able to apply sufficient force to the apparatus 100 to deploy the deployable element.

In some embodiments, such as described in connection with FIG. 2, shear mechanisms, such as shear bolts or shear pins, may be used to enable the apparatus to avoid deploying when persons or objects apply forces lesser in magnitude than the applied force 105 from the vehicle. Such shear mechanisms, or other triggering mechanisms that are configured to permit deployment of the deployable elements in response to the applied force from the vehicle and to prevent deployment in response to lesser forces, may provide significant advantages when deployed in venues where many people are expected to walk, for example, or where it is otherwise desirable to allow safe passage of light objects over the vehicle barrier apparatus 100.

It should be noted that the vehicle receiving member 109 may take other forms other than the plate-like form with slits, as described hereinabove. For example, in some embodiments, the vehicle receiving member may include a series of connected rods or slats, for example. Thus, it should be understood that embodiments shown and described in the application in the present application should not be considered limiting with respect to the form of the vehicle receiving member in the claims.

Many other variations in form and structure of the components described in connection with FIG. 1 are possible and will become apparent to those of ordinary skill in the relevant art in reference to other drawings and other portions of this description. With many of today's vehicles being front-wheel drive, it will be advantageous to impede motion of the threatening vehicle by stopping, impeding, deflecting, or damaging the power-driving front wheels of the vehicle. An advantage of the apparatus 100 and other embodiments described herein over much of the prior art is that front wheels of a vehicle can be engaged and damaged by deployment of the embodiments to impede vehicle motion, in addition to engaging rear wheels of the vehicle and even the car's chassis in some cases.

Figure 2:
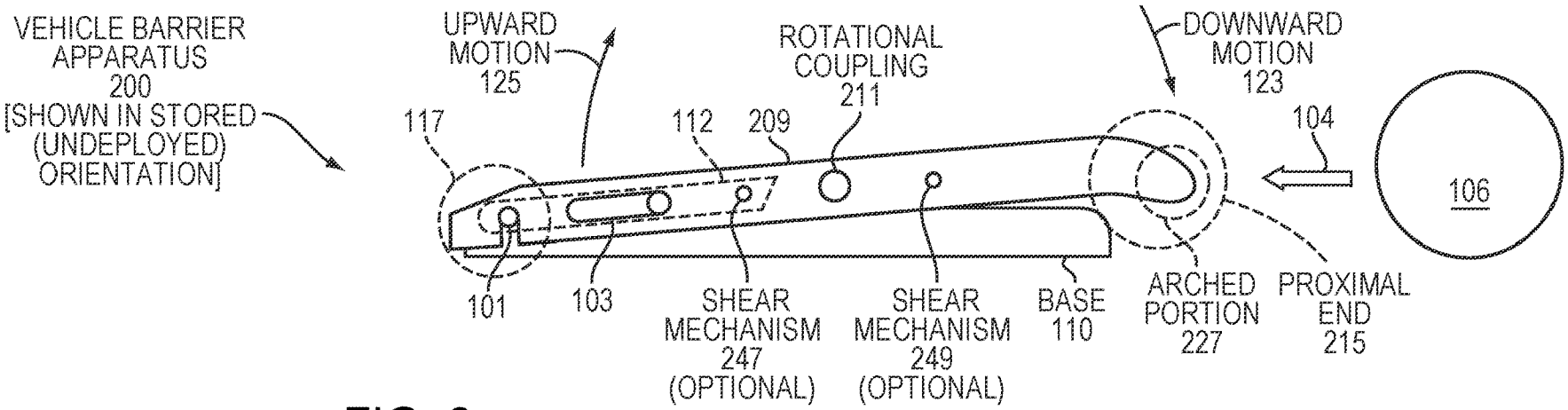
FIG. 2 is a profile-view illustration of an alternative embodiment vehicle barrier apparatus in a stored (undeployed) orientation, with the apparatus including optional shear mechanisms and an arched portion of a vehicle receiving member.
Figure 3:
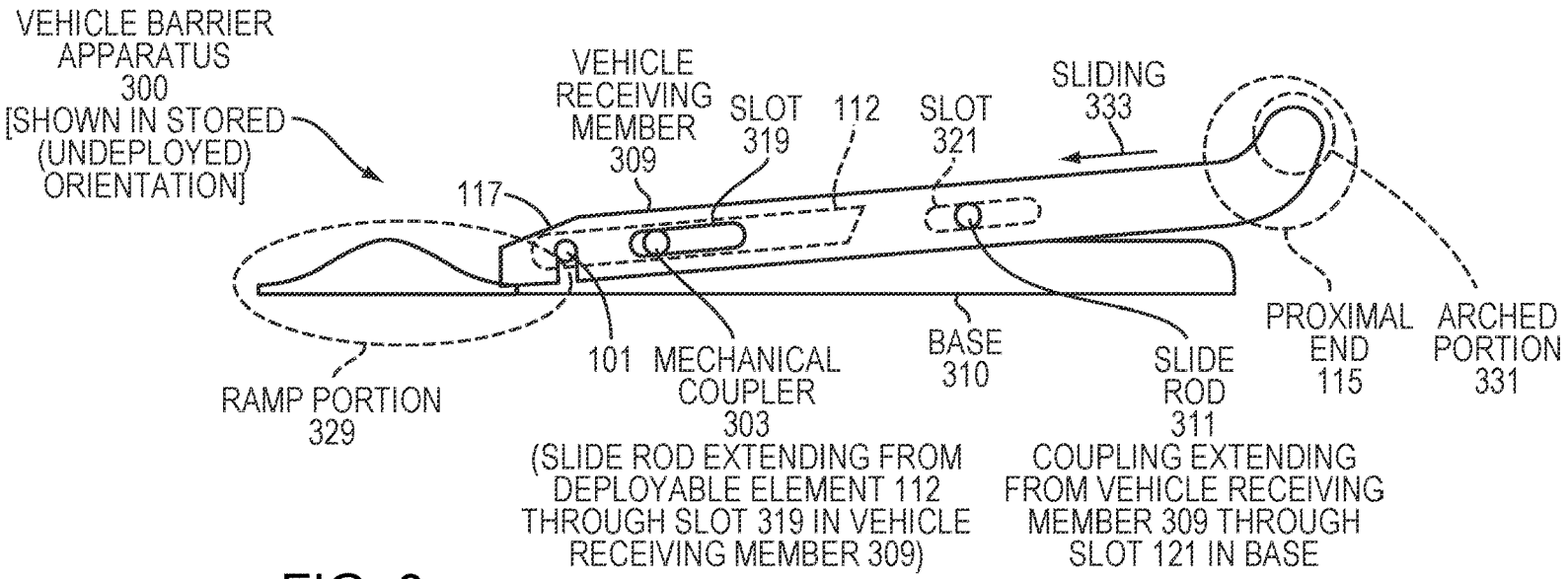
FIG. 3 is a profile-view diagram of an alternative vehicle barrier apparatus, in a stored orientation, in which a vehicle receiving member of the apparatus is configured transfer force to a deployable element by sliding, rather than by rotating.

FIG. 2 is a profile-view drawing illustration of an alternative embodiment vehicle barrier apparatus 200, which is shown in the stored (undeployed) orientation. FIG. 2 illustrates various optional features that can be incorporated in many of the embodiments described herein. The apparatus 200 includes, in addition to the base 110 and deployable element 112, a vehicle receiving member 209.

At a proximal end 215 of the vehicle receiving member 209, the member 209 has an arched portion 227. The arched portion 227 assists the vehicle receiving member 109 in receiving impact force from the wheel 106 and in converting the force appropriately to the transfer force 107 that is illustrated in FIG. 1. In particular, the vehicle receiving member 209 is rotationally coupled to the base 110 via a rotational coupling 211 thus, as the vehicle receiving member 209 receives applied force from the wheel 106 (applied force not illustrated in FIG. 2, but is illustrated in FIG. 1), the vehicle receiving member 209 is urged to rotate about the rotational coupling 211, including a generally downward motion 123 of the proximal end 215 toward the base 110 and the ground, and with a generally upward motion 125 of the distal end 117, generally upward and away from the ground and from the base 110.

If the wheel 106 is moving sufficiently rapidly toward the apparatus 200, much of the applied force from the vehicle may have a tendency to push horizontally against the vehicle receiving member 209. The arched portion 227 can assist the vehicle receiving member 209 to convert force from the wheel 106 into the downward motion 123 (and also the upward motion 125) instead of having such a strong tendency to simply push or translate the vehicle barrier apparatus 200.

FIG. 2 also illustrates one way in which a triggering mechanism can be mechanically connected, directly or indirectly, to the vehicle receiving member. In general, a triggering mechanism may be configured to permit deployment of the deployable element in response to the applied force from the vehicle and to prevent deployment of the deployable element in response to a force lesser in magnitude than the applied force from the vehicle. Some of these triggering mechanisms are shearing mechanisms that are configured to be sheared responsive to the applied force from the vehicle. A shearing mechanism may include a shear pin or shear bolt, or a combination of two or more of these items, for example.

FIG. 2 illustrates two potential locations for shear mechanisms. A shear mechanism 247 is illustrated in a moderately central portion of the vehicle barrier apparatus 200. The shear mechanism 247 secures the deployable element 112 to the vehicle receiving member 209, or to the base 110, or to both. The shear mechanism 247 has a tendency to keep these components fixed with respect to each other, such that any applied force, exerted on the vehicle receiving member 209, that is lesser in magnitude than the applied force from a vehicle cannot cause the vehicle barrier apparatus 200 to be deploy (i.e., cause the deployable element 112 to move to the deployed orientation), because any applied force is not sufficient for the vehicle receiving member 209 to create enough transfer force to be exerted on the deployable element 112 to break the shear mechanism 247. However, when the vehicle 102 impinges on the arched portion 227 of the proximal end 215 of the vehicle receiving number 209, the applied force is sufficient to break the shear mechanism 247, resulting in the upward motion 125 of the vehicle receiving member 209 and the deployment.

In an alternative example, a shear mechanism 249 is illustrated between the proximal end 215 and the rotational coupling 211 of the vehicle receiving member 209. The shear mechanism 249 extends through the vehicle receiving member 209 and the base 110, securing them together and preventing rotation about the rotational coupling 211, thus preventing deployment of the deployable element 112, until the vehicle receiving element 209 receives an applied force of the magnitude expected from the vehicle 102. Persons of ordinary skill in the art in the mechanical arts will readily understand that shear pins, shear bolts, or other shear mechanisms may be applied at various other locations in various embodiments apparatuses described herein to obtain the noted advantages. These persons will readily understand how shear mechanisms are to be selected based on their specifications and on the specific geometry of the vehicle barrier apparatus and types of vehicle threats to be protected against.

In other embodiments, a triggering mechanism may be a different type of mechanism, such as a latch that prevents rotation of the vehicle receiving member 209 until a force sensor (e.g., located at the proximal end 215), indicates a high enough value representative of a vehicle threat and causes the latch to be to release the vehicle receiving member 209 electromechanical. Further alternatively, the triggering mechanism may include a latch remotely actuated by wired or wireless electrical circuit.

FIG. 3 is a profile-view illustration of an alternative vehicle barrier apparatus 300, shown in a stored (undeployed) orientation. In the apparatus 300, a coupling 311 between the between a vehicle receiving member 309 and a base 310 is primarily a translational slide coupling. This is as opposed to the rotational coupling 211 in FIG. 2, which is purely a rotational coupling. However, as will be described in following, the coupling 311 allows for some rotation of the vehicle receiving member 309 with, respect to the base, about the rotational coupling 311, which functions to facilitate deployment of the a deployable element of the apparatus 300. Accordingly, consistent with usage of "rotational" coupling herein, the coupling 311 may be consider a rotational coupling. Instead, the coupling 311 is a slide rod extending from the vehicle receiving member 309 through a slot 321 in the base 310. Upon receiving applied force from a vehicle 102, the vehicle receiving member 309 can pivot about the base, but the position of its pivot with respect to the base is not confined and defined exactly, as it is by the rotational coupling 211 in FIG. 2.

Applied force from the vehicle has a principal tendency to push the vehicle receiving member 309 in the direction of the distal end 117. The vehicle receiving member 309 is enabled to slide left with respect to the base 310, with the slide rod 311 sliding left with a sliding motion 333, as illustrated, through the slot 321 in the base 310. The base 310 includes a ramp portion 329 adjacent to the distal end 117 of the vehicle receiving member 309. As the vehicle receiving member 309 slides left with the sliding motion 333, the vehicle receiving member 309 the distal end 117 of the vehicle receiving member 309 slides up the ramp portion 329 of the base 310. This forces the distal end 117 upward. The sliding of the distal end 117 of the vehicle receiving member 309 up the ramp portion 329 of the base 310 causes some rotation of the vehicle receiving member 309 with respect to the base 310 about the mechanical coupler 303, which facilitates deployment of the deployable element 112 because a slot in the distal end 117 forces up the deployable element as the slot rises. Thus, the mechanical coupler 303 is still a "rotational" coupler as the term is used herein.

Furthermore, a mechanical coupler 303 that couples the deployable element 112 to the vehicle receiving member 309, in this embodiment, is a slide rod that extends from the deployable element 112 through a slot 319 defined within the vehicle receiving member 309. The generally upward motion of the distal end 117 of the vehicle receiving member 309, thus, has a tendency to pull up the mechanical coupler 303 (slide rod), which forces the deployable element 112 upward, causing it to rotate counterclockwise about the rotational coupling 101 of the deployable element to the base 310, deploying the deployable element 112. The proximal end 115 of the vehicle receiving member 309 includes an arched portion 331, which is arched upward, thus assisting the vehicle receiving member 309 in absorbing the impact and applied force from the vehicle wheel 106 (not illustrated in FIG. 3).

Figure 4:
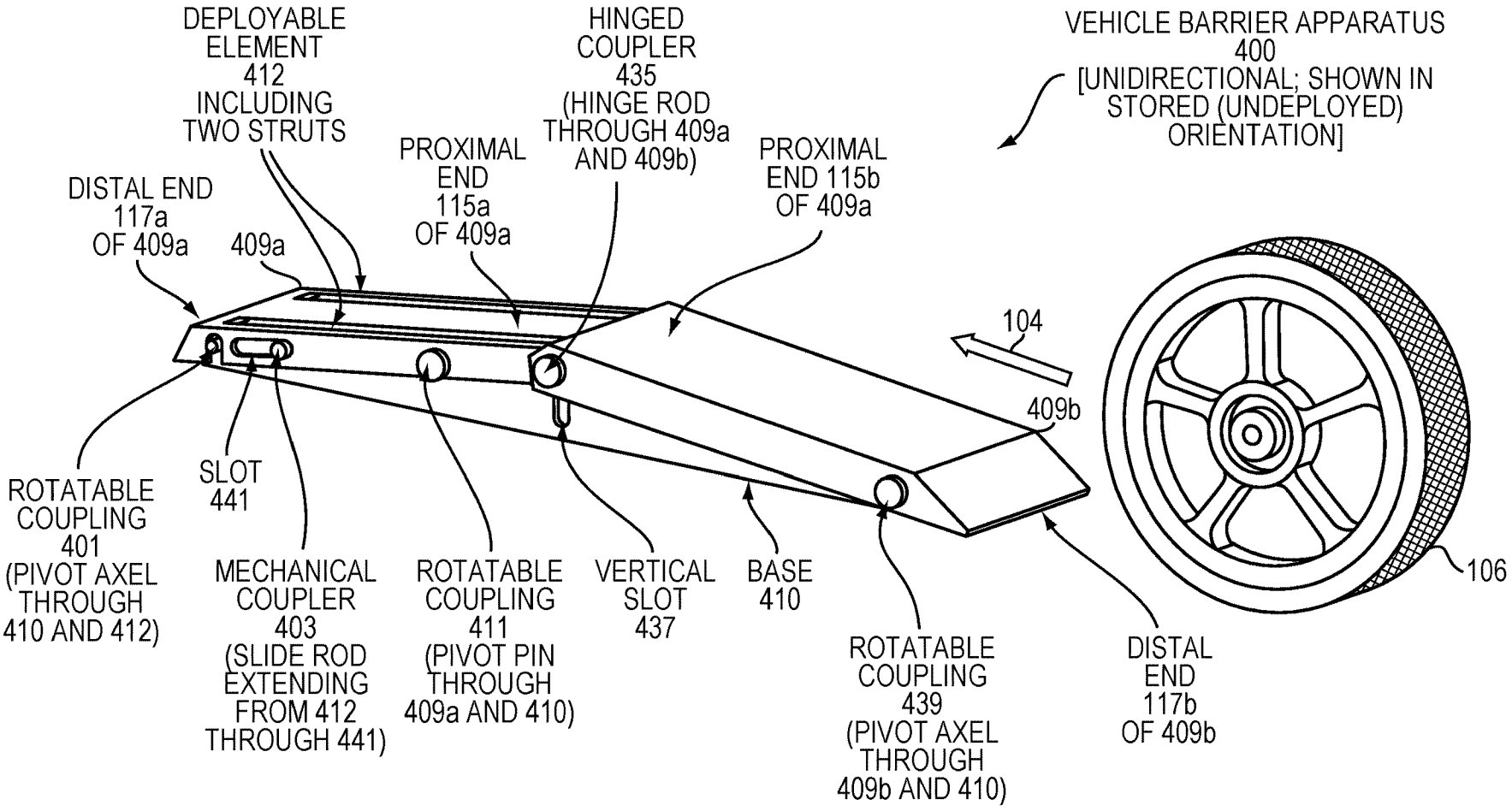
FIG. 4 is a perspective-view illustration of an alternative vehicle barrier apparatus that is unidirectional, shown in an undeployed orientation, where the apparatus includes a second vehicle receiving member that is hingedly coupled to a first vehicle receiving member.

FIG. 4 is a perspective-view illustration of an embodiment vehicle barrier apparatus 400. The apparatus 400 is unidirectional, in that it is principally configured to inhibit motion of a vehicle traveling in one direction, namely the direction 104. The vehicle of barrier apparatus 400 is illustrated in a stored (undeployed) orientation, but FIG. 5, described hereinafter, illustrates the same vehicle barrier apparatus 400 in a deployed orientation.

The apparatus 400 includes two vehicle receiving members, a first vehicle receiving member 409*a* and a second vehicle receiving member 409*b*. The members 409*a* and 409*b* are coupled together via a hinged coupler 435. In this embodiment, the hinged coupler 435 is a hinge rod extending through the vehicle receiving members 409*a* and 409*b*. However, it should be understood that in other embodiments, the hinge coupler 435 can take other forms, such as a flexture.

The second vehicle receiving member 409*b* serves as a ramp for the vehicle wheel 106. Through the hinged coupler 435, the second member 409*b* transfers the applied force from the vehicle wheel to the first vehicle receiving member 409*a*, even when the vehicle wheel 106 is only contacting the second vehicle receiving member 409*b*. This arrangement is advantageous because it provides a smooth surface for people and objects that are not threatening to move smoothly over the apparatus 400 when the apparatus is not deployed. This arrangement with two vehicle receiving members further has the advantage of transferring force that can be applied to deployment potentially earlier, ensuring that the apparatus 400 is deployed prior to the front wheel 106 of the vehicle impinging on the first vehicle receiving member 409*a*.

The first vehicle receiving member 409*a* is coupled, rotatably in this case, to a base 410 and has proximal and distal ends 115*a* and 117*a*, respectively. Similarly, the coupling is via a rotatable coupling 411, in this case a pivot pin through the vehicle receiving member 409*a* and the base 410. The second vehicle receiving member 409*b* is also rotatably coupled to the base, via a rotatable coupling 439 (in this embodiment, a pivot axle through the member 409*b* and the base 410).

It should be noted that the rotational coupling 411 for the member 409*a* is located more or less centrally to the first member 409*a*. In contrast, the rotatable coupling 439 for the second member 409*b* is much closer to a distal end 117*b* of the second vehicle receiving member 409*b*. The second vehicle receiving member 409*b* also has a proximal end 115*b*, and the proximal ends 115*a* and 115*b* of the first and second members 409*a* and 409*b*, respectively, are hingedly coupled via the hinge coupler 435. Thus, the apparatus 400 is configured such that the wheel 106, traveling in the direction 104, will first impinge on the apparatus at the distal end 117*b* of the second member 409*b*, which serves as a ramp.

The apparatus 400 also includes a deployable element 412. As can be viewed more readily in the deployed orientation of FIG. 5, the deployable element 412 includes two struts. In other embodiments, a deployable element may include only a single strut, or may include any number of struts, or a single rectangular plate, that rises rotatably rises from the first vehicle receiving member 409*a*, for example. It should be understood that the deployable element, in various embodiments consistent with the description herein and with the claims, may include a wide variety of configurations that are not explicitly enumerated but will recognized by those skill in the relevant arts in view of this specification.

The deployable element 412 is rotatably coupled to the base 410 at a rotatable coupling 401 (in this embodiment, a pivot axle through the base 410 and the deployable element 412. The deployable element 412 is also coupled to the vehicle receiving the first vehicle receiving member 409*a* at a mechanical coupler 403 (in this embodiment, a slide rod extending from the deployable element 412 through a slot 441 defined within the first vehicle receiving member 409*a*. It should be noted that the mechanical coupler 403 is located closer to the distal end 117*a* of the first vehicle receiving member 409*a* than to the proximal end 115*a* thereof.

The deployable element 112 is configured to receive a transfer force, from the vehicle receiving member 409*a*, via the mechanical coupler 403, responsive to the first vehicle receiving member 409*a* receiving an applied force from the vehicle at the proximal end 115*a* of the first vehicle receiving member 409*a*.

The applied force 105 from the vehicle wheel 106, which is illustrated in FIG. 5, is first applied directly to the vehicle receiving member 409*b*. Nonetheless, the first vehicle receiving member 409*a* also receives the applied force 105 at this initial stage via the hinge coupler 435 that couples the two vehicle receiving members 409*a* and 409*b* together. Then, at a later stage, as the wheel 103 continues up to traverse the second vehicle receiving member 409*b*, the wheel 106 may eventually cross the hinge coupler 435 and impinge directly on the proximal end 115*a* of the first vehicle receiving member 409*a*. The first vehicle receiving member 409*a* is, thus, configured to receive the applied force 105 illustrated in FIG. 5 at the proximal end 115*a* of the vehicle receiving member first vehicle receiving member 409*a* via the hinge coupler hinge rod 435, responsive to the vehicle 102 contacting the second vehicle receiving member 409*b*.

As the vehicle receiving members experience the applied force either directly or indirectly, the hinge rod coupler 435 is forced downward, further into the base and toward the ground, through a vertical slot 437 defined within the base 410. The vertical slot 437 is configured to accommodate a downward sliding of the hinge rod 435 therein in response to the applied force 105 illustrated in FIG. 5. As this occurs, the first vehicle receiving member 409*a* rotates with respect to the fixed pivot pin rotational coupling 411, causing an upward motion of the distal end 117*a* of the first vehicle receiving member 409*a*. In this manner, the slide rod 403 is forced to move upward and through the slot 441 toward the left of the slot 441, such that the deployable element 412 rotates counterclockwise, about the rotatable coupling 401, into the deployed orientation illustrated in FIG. 5.

In this embodiment, the upward force of the slot 441 on the mechanical coupler slide rod 403 is a transfer force. This transfer force 107 causes the deployable element 412 to deploy from the stored orientation to the deployed orientation shown in FIG. 5 responsive to the transfer force 107, with a deployment motion 559 of the deployable element 412 that is illustrated in FIG. 5. The motion 559 of the deployable element 412 is part of an overall counterclockwise rotation of the deployable element 412 about the rotatable coupling 401 during deployment.

FIG. 5, in addition to the features noted above hereinabove, further illustrates that the struts of the deployable element 412 include spikes 530 at the vehicle engagement ends thereof. The spikes 530 facilitate disabling and impeding motion of the vehicle 102 by puncturing the wheel 106 or by engaging an underside chassis portion of the vehicle 102, for example. FIG. 5 also illustrates the download motion 123 of the proximal end 115*a* of the first vehicle receiving member 409*a* and the upward motion 125 of the distal end 117*a* of the first vehicle receiving member 409*a*, both motions being resulting from the rotation of the first vehicle receiving member 409*a* about the rotatable coupling pivot pin 411. It will be understood that the upward motion 125, which is motion of the distal end 117*a* of the first vehicle receiving member 409*a* upward and away from the base 410 and from the ground on which the base sits. It is this upward motion 125 that mechanically forces the deployable element 412 from the stored orientation illustrated in FIG. 4 to the deployed orientation illustrated in FIG. 5, with the mechanical coupler 403 forced to slide from one side of the slot 441 to the other side of the slot 441, which can be visualized by comparing a position of the mechanical coupler slide rod 403 in the slot 441 in FIG. 4 and the position in FIG. 5.

It will be understood from the description hereinabove that, because of the hinged coupler 435, which is a hinge rod in the apparatus 400, applied forces from the vehicle acting on one of the vehicle receiving members 409*a*, 409*b* also act on the other vehicle receiving member 409*a*, 409*b*. In particular, applied force from the vehicle on most portions of the second vehicle receiving member 409*b* also acts on the proximal end 115*a* of the second of the first vehicle receiving member 409*a* via the hinge coupler 435.

FIG. 6 is a profile-view illustration of a vehicle barrier apparatus 600. The apparatus 600 is bidirectional, meaning that it is configured to impede motion of a vehicle traveling in either of two different opposing directions, generally either from the right to the left of FIG. 6, or from the left to the right of FIG. 6, for example. FIG. 6 shows the apparatus 600 in a stored (undeployed) orientation, while FIG. 7 illustrates the same vehicle barrier apparatus 600 in a partially deployed orientation. The apparatus 600 may be considered a variation of the apparatus 400 illustrated in FIGS. 4-5. Many of the features are the same, but there are modifications that permit the second vehicle receiving member to transfer force to a second deployable element.

The apparatus 600 includes a base 610, a first vehicle receiving member 409*a*, and a second vehicle receiving member 609. The first vehicle receiving member 409*a* includes many features that are the same as features illustrated in FIGS. 4-5. Where reference numbers are the same, it should be understood that the features are the same.

In particular, the relationship of the first vehicle receiving member 409*a* to the base 610 is the same as that described in FIGS. 4-5. The relationship of the two vehicle receiving members 409*a* and 609 in FIG. 6 is also similar to the relationship between the members 409*a* and 409*b* in FIGS. 4-5. However, in addition to what was illustrated in FIGS. 4-5, in the apparatus 600, the vehicle receiving members form a slot 645 that allows the hinged coupler 435 to shift slightly within the slot 645. The members 409*a* and 609 can slide horizontally slightly with respect to each other as they are pushed down into the vertical slot 437. Differing from the apparatus 400 of FIGS. 4-5, the apparatus 600 includes, with the second vehicle receiving member 609, a second rotatable coupling pivot pin 411. Thus, the hinged coupler 435, as it is pushed down into the vertical slot 437, causes both the first and second vehicle receiving members 409*a* and 609 to rotate about their respective rotatable couplings 411, causing upward motion of both distal ends 117*a* and 117*b* of the members 409*a* and 609, respectively.

Further, as illustrated more fully in FIG. 7, the apparatus 600 includes two deployable elements 712, each stored within a profile of the respective vehicle receiving members 409*a*, 609 when undeployed, as illustrated in FIG. 6. The second deployable element 712, which is on the right side of FIGS. 6-7, is rotatably coupled to the base via a rotatable coupling pivot axle 401 through the base 610 and the deployable elements 712. The right side of FIGS. 6-7 also includes a mechanical coupler 403, namely a slide rod extending from the deployable element 712 through a slot 441 defined within the second member 609, just as for the left side of FIGS. 6-7. Thus, the right side of FIGS. 6-7 is enabled to operate in a similar way as the left side of FIGS. 6-7 and of FIGS. 4-5, such that both deployable elements 712 can be deployed when the proximal ends 115*a*, 115*b* (or either of them) receives the applied force 105 from the vehicle wheel 106.

Thus, the deployable element 712 on the left is a first deployable element, while the deployable element 712 on the right is a second deployable element. The left and right mechanical couplers 403 are first and second mechanical couplers, respectively, and the second mechanical coupler 403 on the right is located closer to the distal end 117*b* of the second vehicle receiving member 609 then to the proximal end 115*b* of the second member 609. The second deployable element 712 on the right is configured to receive an upward transfer force 107, exerted by the slot 441 on the mechanical coupler slide rod 403 (the second deployable element thus receiving the transfer force 107 from the second vehicle receiving member 609 via the second mechanical coupler 403, thus forcing the second deployable element 712 on the right of FIGS. 6-7 to deploy upward.

It should be understood that the transfer force being received is responsive to the second vehicle receiving member 609 receiving the applied force 105 from the vehicle 102 (or wheel 106 thereof) at the proximal end 115*b* of the second vehicle receiving member 609. The second vehicle receiving member 609 receives the applied force 105 at the proximal end 115*b* thereof either directly, via the wheel 106 impinging on the proximal end 115*b*, or indirectly, by means of the hinged coupler 435 and the proximal ends 115*a*, 115*b* being coupled together, when the wheel 106 impinges upon the proximal end 115*a* of the first vehicle receiving member 409*a*. The second deployable element 712, at the right of FIG. 7, is, thus, configured to deploy from the stored orientation illustrated in FIG. 6 to the deployed orientation illustrated in FIG. 7 responsive to the second responsive to the transfer force 107 at the right of FIG. 7, which may be considered a second transfer force, with the first transfer force 107 being illustrated at the left of FIG. 7.

In the embodiment of FIGS. 6-7, the first and second deployable elements 712 are configured to deploy with rotations about the base, particularly about the rotatable couplings 401 through the base 610, in mutually opposing rotational directions 708*a* and 708*b*. The rotational deployment direction 708*a* is counterclockwise about the pivot axel 401 on the left of FIG. 7, while the rotational deployment direction 708*b* is clockwise about the pivot axel 401 on the right of FIG. 7. Accordingly, the deployable element 712 on the right of FIG. 7 inhibits motion of the wheel 106 or vehicle 102 incident from the left of FIG. 7, while the deployable element 712 at the left of FIG. 7 inhibits motion of the wheel 106 or vehicle 102 traveling from the right of FIG. 7 toward the left, when the apparatus is in its deployed orientation.

It will be understood that the slide rods 403, the hinged coupler 435, and the rotatable couplings 411, as well as other components, may be coated with a low-friction coating to promote sliding of the rod within the slot with low friction, and preventing corrosion of the contacting parts. A low-friction coating can include a Teflon or another low-friction, rigid coating. A low-friction coating can also include a grease or another lubricant coatings.

Figure 8:
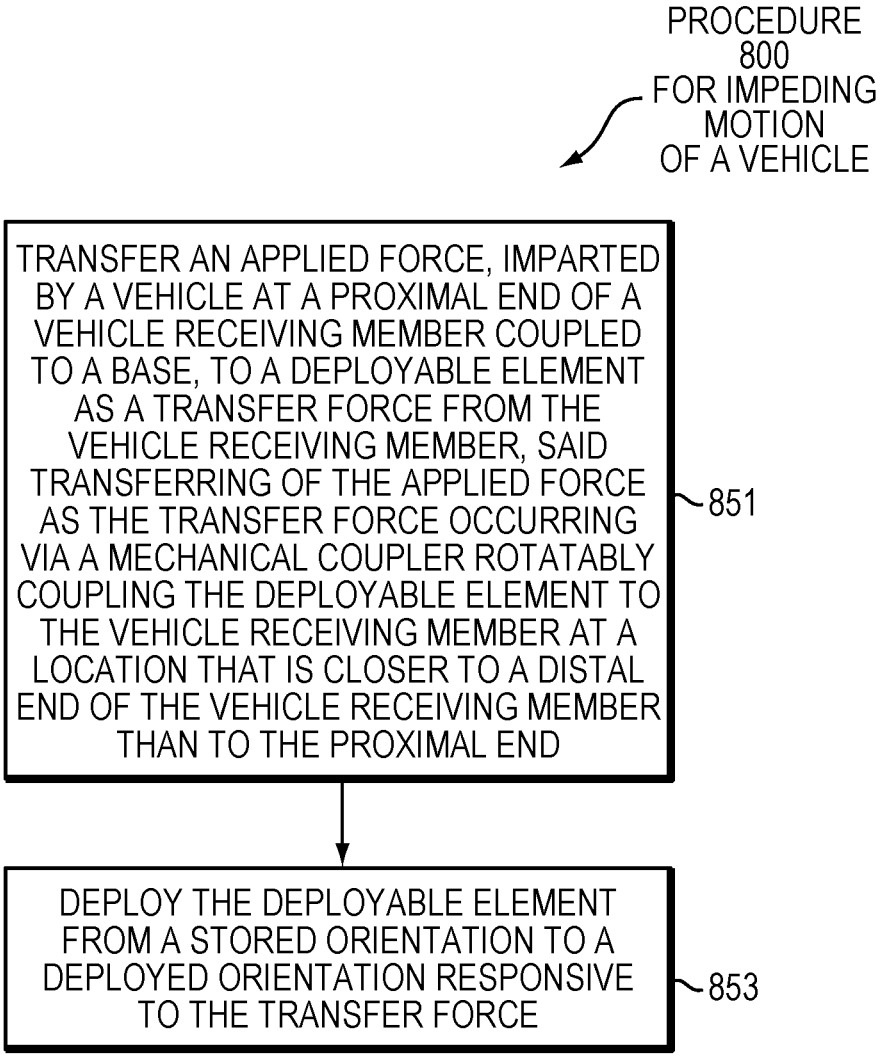
FIG. 8 is a flow diagram illustrating an embodiment procedure for impeding motion of a vehicle.

FIG. 8 is a flow diagram illustrating a procedure 800 for impeding motion of a vehicle. At 851, an applied force is transferred, where the applied force is imparted by a vehicle at a proximal end of a vehicle receiving member rotatably coupled to a base. The applied force is transferred to a deployable element as a transfer force from the vehicle receiving member, and transferring of the applied force as the transfer force occurs via a mechanical coupler rotatably coupling the deployable element to the vehicle receiving member at a location that is closer to a distal end of the vehicle receiving member than to the proximal end.

At 853, the deployable element is deployed from a stored orientation to a deployed orientation responsive to the transfer force.

Figure 9:
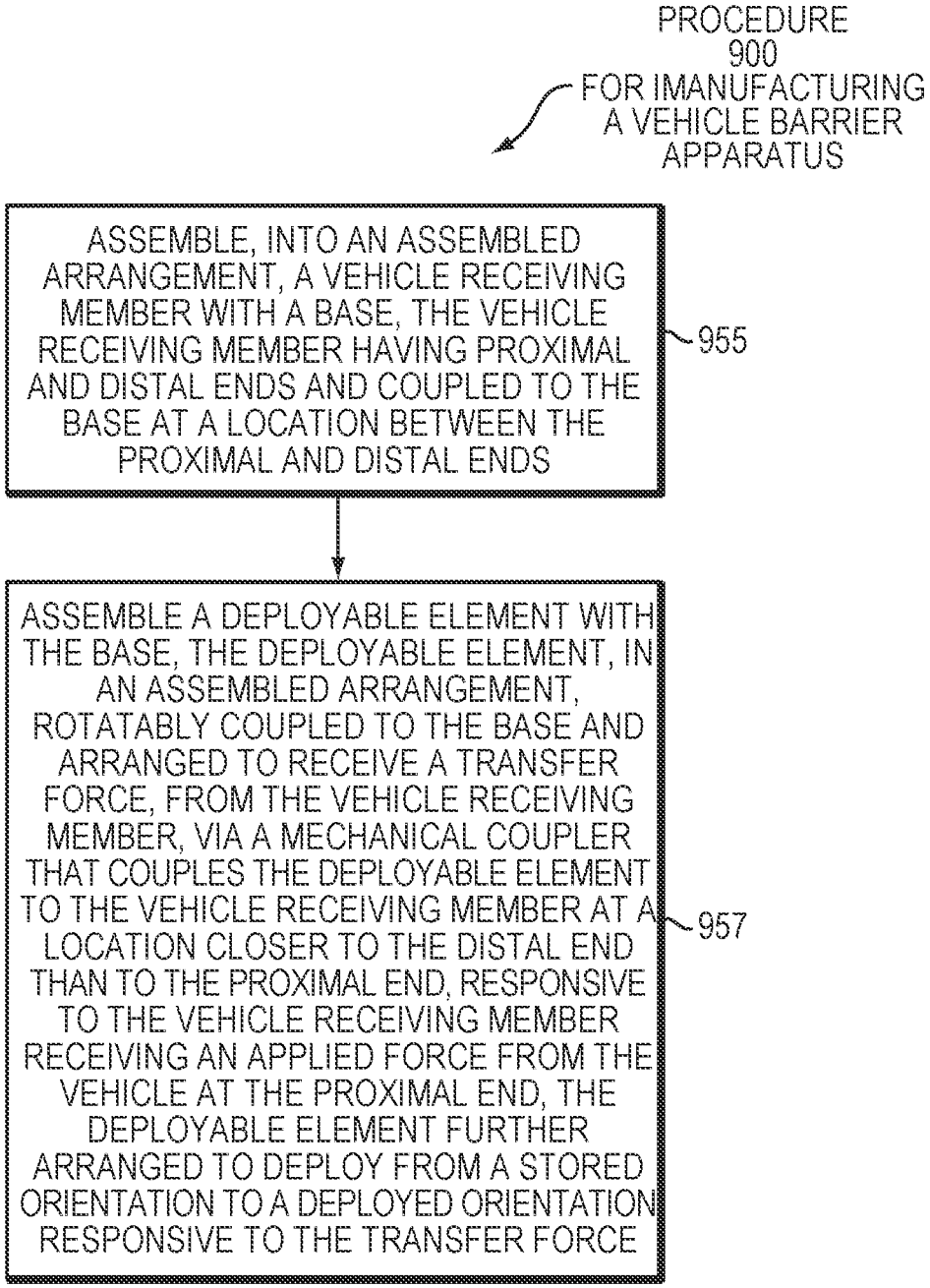
FIG. 9 is a flow diagram illustrating an embodiment procedure for manufacturing a vehicle barrier apparatus.

FIG. 9 is a procedure is a flow diagram illustrating a procedure 900 for manufacturing a vehicle barrier apparatus. At 955, a vehicle receiving member is assembled into an assembled arrangement with a base. The vehicle receiving member, in the assembled arrangement, has proximal and distal ends and rotatably is rotatably coupled to the base at a location between the proximal and distal ends.

At 957, a deployable element is assembled with the base, where the deployable element, in an assembled arrangement, is rotatably coupled to the base and is arranged to receive a transfer force. The transfer force is received from the vehicle receiving member, via a mechanical coupler that couples the deployable element to the vehicle receiving member at a location closer to the distal and then to the proximal and, responsive to the vehicle receiving member receiving an applied force from the vehicle at the proximal end. The deployable element is further arranged to deploy from a stored orientation to a deployed orientation responsive to the transfer force.

Figure 10:
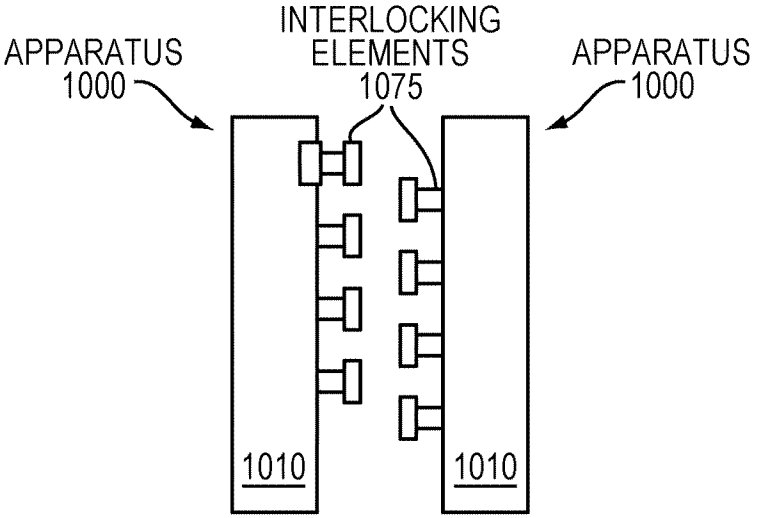
FIG. 10 is a plan-view illustration of an embodiment apparatus that includes interlocking features for attachment to another vehicle barrier apparatus.

FIG. 10 is a plan-view diagram of an apparatus 1000 that has interlocking elements 1075. In particular, the apparatus 1000 has a base 1010 that has the interlocking elements 1075 protruding therefrom. The interlocking elements 1075 are configured to interlock with another apparatus 1000, such that the two bases 1010 can be held fixedly with respect to each other. In this manner, multiple vehicle barrier apparatuses can be attached to each other to create a wider overall barrier where needed for a particular venue to ensure that no vehicle can pass thereby. The interlocking elements 1075 may be dovetail elements, for example. However, they may be of many other types, such as hook and eye latches, straps or cables with attachment loops, etc.

Figure 11:
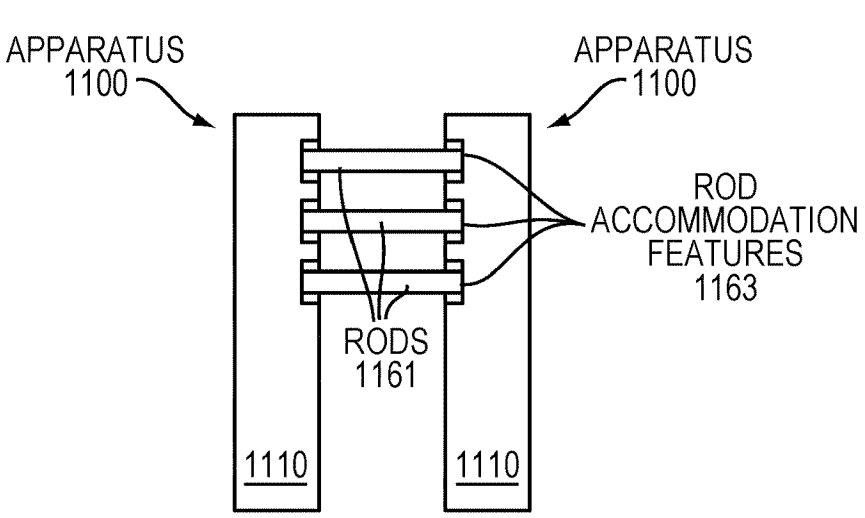
FIG. 11 is a plan-view illustration of an embodiment apparatus that includes features for attaching more than one vehicle barrier apparatus together via rod connectors.

FIG. 11 is a plan-view diagram of an apparatus 1100 that has a base 1110 that is configured to attach with another base 1110 of another apparatus 1100 via rods 1161. In particular, the apparatus 1100 has rod accommodation features 1163 that permit the rods 1161 to secure the two bases 1110 together. In this manner, multiple vehicle barrier apparatuses can be attached to each other to create a wider overall barrier. The rod accommodation features may be holes, shafts, U-shaped clamps, or any other features that enable the rods to secure one vehicle barrier apparatus together with one or more other vehicle barrier apparatuses.

Figure 12:
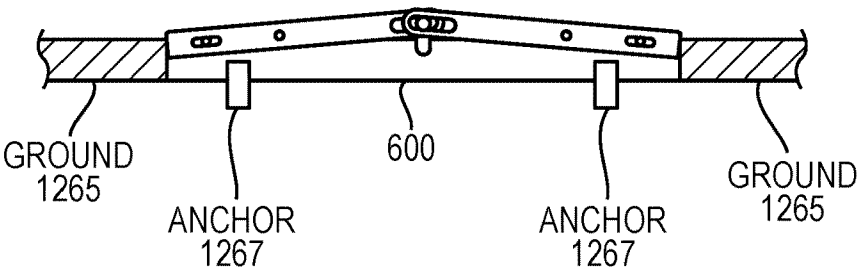
FIG. 12 is a cross-sectional-view illustration of an embodiment vehicle barrier apparatus installed below ground.

FIG. 12 is a cross-sectional view diagram of the apparatus 600 of FIGS. 6-7 that is modified in its placement below a ground surface. The ground 1265 may include a roadway, a sidewalk, a dirt area, etc. An indentation or depression in the ground 1265 is formed to accommodate the apparatus 600. Optionally, anchors 1267 may be applied to anchor the base of the apparatus 600 to the surface below it. Such anchors 1267 can be used in this embodiment, or in any other embodiments, to secure, either temporarily or permanently, an embodiment apparatus to a surface below the base.

Figure 13:
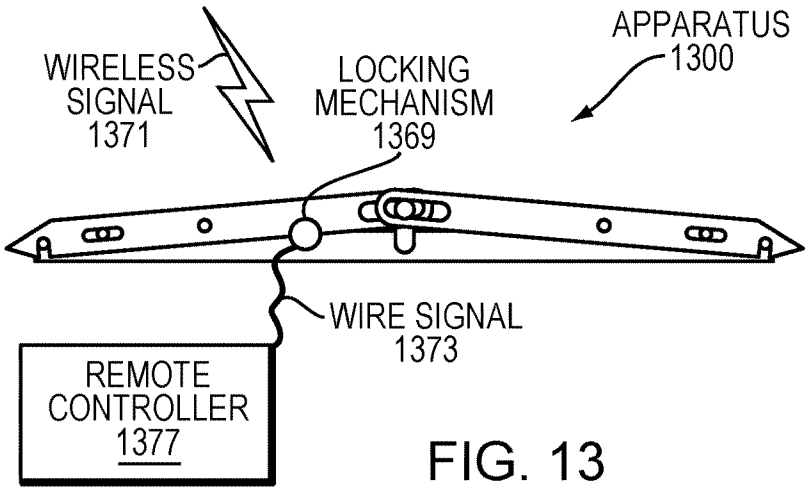
FIG. 13 is a profile-view illustration of an embodiment vehicle barrier apparatus that includes locking mechanism that can be used to prevent deployment and that can be controlled manually or remotely.

FIG. 13 is a profile-view diagram of a vehicle barrier apparatus 1300 that is similar to the vehicle barrier apparatus 600 of FIGS. 6-7, but is modified to include a locking mechanism 1369. The locking mechanism is configured to prevent the apparatus from deploying. This can permit, for example, any vehicle to pass over the apparatus safely in case such an arrangement is needed. In addition, the locking mechanisms 1369 can be used to transport the apparatus 1300 safely or can be used during setup, such that no accident can cause the apparatus 1300 to deploy.

In some embodiments, the locking mechanism 1369 can be manually controlled, such as by a person inserting a locking pin into a hole that extends between the vehicle receiving member and the base, or by removing such a locking pin. In another embodiment, the locking mechanism 1369 includes an electromechanical actuator and a receiver that receives a wireless signal 1371 that controls whether the locking mechanism 1369 is applied or disabled.

In yet another embodiment, the electro-mechanically controlled locking mechanism 1369 can be controlled via a wire signal 1373 from a remote controller 1377. In this manner, and operator or police officer at a checkpoint, for example, may control the locking mechanism 1369 via a wireless signal or a wired signal to enable the locking mechanism 1369 to prevent deployment, or to disable the locking mechanism 1369, allowing the apparatus 1300 to deploy when impinged upon by a vehicle threat.

It should be understood that many other variations and elements can be applied to the embodiments herein without departing from the scope of the invention. For example, one or more edges of a deployable element may be serrated in order to inflict maximum damage on a threatening vehicle. In another example, vehicle barrier apparatuses may be marked to be highly visible, such that they are not trip hazards for people, or such that vehicles that are not threats can avoid them. In one example, the marking can include highly reflective tape or paint. Furthermore, the barriers can be configured to be locked mechanically or electrically so that any vehicle can pass over the vehicle barrier apparatus without deploying it. In some embodiments, deployment can be initiated manually with a mechanical key or tool, such that the apparatus remains deployed It should further be understood that the procedures 800 and 900 in FIGS. 8-9, respectively, may be modified to include any of the features described herein in respect to any of the embodiments. For example, the procedure 800 for impeding motion of a vehicle may include using, implementing, or deploying any of the mechanical features or embodiments described herein with respect to any of the embodiments. Moreover, the procedure 900 for manufacturing a vehicle barrier apparatus may include assembling any of the mechanical features shown or described in the application. Furthermore, it should be understood that any of the embodiments described herein, whether apparatuses or procedures, may include other features and options that are known in the art. For example, any of the embodiments may incorporate features that are known from U.S. Non-Provisional patent application Ser. No. 15/657,089, filed on Jul. 21, 2017, the entire contents of which are incorporated herein by reference.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

What is claimed is:

1. A vehicle barrier apparatus comprising:

a base;

a vehicle receiving member coupled to the base and having proximal and distal ends; and a deployable element rotatably coupled to the base and coupled to the vehicle receiving member at a mechanical coupler located closer to the distal end than to the proximal end, the deployable element configured to receive a transfer force, from the vehicle receiving member, via the mechanical coupler, responsive to the vehicle receiving member receiving an applied force from a vehicle at the proximal end, the deployable element configured to deploy from a stored orientation to a deployed orientation responsive to the transfer force, wherein the mechanical coupler comprises a slide rod extending from the deployable element and into a slot defined by the vehicle receiving member, the slide rod configured to slide within the slot as the vehicle receiving member applies the transfer force to the deployable element.

2. The apparatus of claim 1, wherein the vehicle receiving member is a first vehicle receiving member, the apparatus further comprising a second vehicle receiving member rotatably coupled to the base and having proximal and distal ends, the proximal end of the second vehicle receiving member being coupled via a hinged coupler to the proximal end of the first vehicle receiving member, and the first vehicle receiving member being configured to receive the applied force at the proximal end thereof via the hinged coupler responsive to the vehicle's contacting the second vehicle receiving member.

3. The apparatus of claim 2, wherein the hinged coupler comprises a hinge rod, and wherein the base defines a vertical slot configured to accommodate a downward sliding of the hinge rod therein in response to the applied force.

4. The apparatus of claim 2, wherein the deployable element is a first deployable element and the mechanical coupler is a first mechanical coupler, the apparatus further comprising a second deployable element rotatably coupled to the base and coupled to the second vehicle receiving member at a second mechanical coupler located closer to the distal end thereof than to the proximal end thereof, the second deployable element configured to receive a transfer force, from the second vehicle receiving member, via the second mechanical coupler, responsive to the second vehicle receiving member receiving the applied force from the vehicle at the proximal end thereof, the second deployable element configured to deploy from a stored orientation to a deployed orientation responsive to the transfer force.

5. The apparatus of claim 4, wherein the first and second deployable elements are configured to deploy with rotations about the base in mutually opposing rotational directions.

6. The apparatus of claim 1, further comprising a triggering mechanism mechanically connected directly or indirectly to the vehicle receiving member, the triggering mechanism configured to permit deployment of the deployable element in response to the applied force from the vehicle and to prevent deployment of the deployable element in response to a force lesser in magnitude than the applied force from the vehicle.

7. The apparatus of claim 6, wherein the triggering mechanism includes a shearing mechanism configured to be sheared responsive to the applied force from the vehicle.

8. The apparatus of claim 1, wherein, in the stored orientation, in profile, the deployable element fits within the base or within the vehicle receiving element.

9. The apparatus of claim 1, wherein the apparatus is a first vehicle barrier apparatus, and wherein the base includes one or more attachment features facilitating attachment of the base of the first vehicle barrier apparatus to one or more corresponding bases of one or more respective second vehicle barrier apparatuses.

10. A method of impeding motion of a vehicle, the method comprising:

transferring an applied force, imparted by a vehicle at a proximal end of a vehicle receiving member rotatably coupled to a base, to a deployable element as a transfer force from the vehicle receiving member, said transferring of the applied force as the transfer force occurring via a mechanical slide rod coupler extending from the deployable element and into a slot defined by the vehicle receiving member and sliding within the slot as the vehicle receiving member applies the transfer force to the deployable element, the mechanical slide rod coupler rotatably coupling the deployable element to the vehicle receiving member at a location that is closer to a distal end of the vehicle receiving member than to the proximal end; and deploying the deployable element from a stored orientation to a deployed orientation responsive to the transfer force.

11. A vehicle barrier apparatus comprising:

means for transferring an applied force, imparted by a vehicle at a proximal end of a vehicle receiving member rotatably coupled to a base, to a deployable element as a transfer force from the vehicle receiving member, said transferring of the applied force as the transfer force occurring via a mechanical slide rod coupler extending from the deployable element and into a slot defined by the vehicle receiving member and sliding within the slot as the vehicle receiving member applies the transfer force to the deployable element, the mechanical slide rod coupler rotatably coupling the deployable element to the vehicle receiving member at a location that is closer to a distal end of the vehicle receiving member than to the proximal end; and means for deploying the deployable element from a stored orientation to a deployed orientation responsive to the transfer force.

12. A method of manufacturing a vehicle barrier apparatus, the method comprising:

assembling, into an assembled arrangement, a vehicle receiving member with a base, the vehicle receiving member having proximal and distal ends and rotatably coupled to the base at a location between the proximal and distal ends; and assembling a deployable element with the base, the deployable element, in an assembled arrangement, rotatably coupled to the base and arranged to receive a transfer force, from the vehicle receiving member, via a mechanical coupler that couples the deployable element to the vehicle receiving member at a location closer to the distal end than to the proximal end, responsive to the vehicle receiving member receiving an applied force from the vehicle at the proximal end, the deployable element further arranged to deploy from a stored orientation to a deployed orientation responsive to the transfer force, wherein the mechanical coupler comprises a slide rod extending from the deployable element and into a slot defined by the vehicle receiving member, the slide rod configured to slide within the slot as the vehicle receiving member applies the transfer force to the deployable element.

13. A vehicle barrier apparatus comprising:

a base;

a vehicle receiving member having proximal and distal ends, the vehicle receiving member rotatably coupled to the base via a rotational coupling positioned between the proximal and distal ends;

a deployable element rotatably coupled to the base to enable a transition from a stored orientation to a deployed orientation, the deployable element being configured in the deployed orientation to engage a vehicle physically; and a mechanical coupler comprising a slide rod extending from the deployable element and into a slot defined by the vehicle receiving member, wherein the vehicle receiving member is configured to rotate in response to an applied force from the vehicle at the proximal end thereof, with a rotation about the rotational coupling, the rotation comprising a downward motion of the proximal end and an upward motion of the distal end, the upward motion mechanically forcing the deployable element from the stored orientation to the deployed orientation, and wherein the slide rod is configured to slide within the slot as the vehicle receiving member rotates with the upward motion of the distal end thereof.

14. The apparatus of claim 13, wherein the vehicle receiving member is a first vehicle receiving member, the apparatus further comprising a second vehicle receiving member rotatably coupled to the base and having proximal and distal ends, the proximal end of the second vehicle receiving member being coupled via a hinged coupler to the proximal end of the first vehicle receiving member, and the first vehicle receiving member being configured to receive the applied force at the proximal end thereof via the hinged coupler responsive to the vehicle contacting the second vehicle receiving member.

15. The apparatus of claim 14, wherein the hinged coupler comprises a hinge rod, and wherein the base defines a vertical slot configured to accommodate a downward sliding of the hinge rod therein in response to the applied force.

16. The apparatus of claim 14, wherein the deployable element is a first deployable element, the apparatus further comprising a second deployable element rotatably coupled to the base to enable a transition from a stored orientation to a deployed orientation, the second deployable element being configured in the deployed orientation to engage a vehicle physically, and wherein the second vehicle receiving member is configured to rotate in response to the applied force from the vehicle at the proximal end thereof, with a rotation comprising a downward motion of the proximal end thereof and an upward motion of the distal end thereof, the upward motion mechanically forcing the second deployable element from the stored orientation to the deployed orientation.

17. The apparatus of claim 16, wherein the first and second deployable elements are configured to deploy with rotations about the base in mutually opposing rotational directions.

18. The apparatus of claim 13, further comprising a triggering mechanism mechanically connected directly or indirectly to the vehicle receiving member, the triggering mechanism configured to permit deployment of the deployable element in response to the applied force from the vehicle and to prevent deployment of the deployable element in response to a force lesser in magnitude than the applied force from the vehicle.

19. The apparatus of claim 18, wherein the triggering mechanism includes a shearing mechanism configured to be sheared responsive to the applied force from the vehicle.

20. The apparatus of claim 13, wherein, in the stored orientation, in profile, the deployable element fits within the base or within the vehicle receiving element.

21. The apparatus of claim 13, wherein the apparatus is a first vehicle barrier apparatus, and wherein the base includes one or more attachment features facilitating attachment of the base of the first vehicle barrier apparatus to one or more corresponding bases of one or more respective second vehicle barrier apparatuses.

22. A vehicle barrier apparatus comprising:

a base;

a vehicle receiving member coupled to the base and having proximal and distal ends; and a deployable element rotatably coupled to the base and coupled to the vehicle receiving member at a mechanical coupler located closer to the distal end than to the proximal end, the deployable element configured to receive a transfer force, from the vehicle receiving member, via the mechanical coupler, responsive to the vehicle receiving member receiving an applied force from a vehicle at the proximal end, the deployable element configured to deploy from a stored orientation to a deployed orientation responsive to the transfer force, wherein the vehicle receiving member is a first vehicle receiving member, the apparatus further comprising a second vehicle receiving member rotatably coupled to the base and having proximal and distal ends, the proximal end of the second vehicle receiving member being coupled via a hinged coupler to the proximal end of the first vehicle receiving member, and the first vehicle receiving member being configured to receive the applied force at the proximal end thereof via the hinged coupler responsive to the vehicle's contacting the second vehicle receiving member.

23. A vehicle barrier apparatus comprising:

a base;

a first vehicle receiving member having proximal and distal ends, the first vehicle receiving member rotatably coupled to the base via a rotational coupling positioned between the proximal and distal ends; and a deployable element rotatably coupled to the base to enable a transition from a stored orientation to a deployed orientation, the deployable element being configured in the deployed orientation to engage a vehicle physically, wherein the first vehicle receiving member is configured to rotate in response to an applied force from the vehicle at the proximal end thereof, with a rotation about the rotational coupling, the rotation comprising a downward motion of the proximal end and an upward motion of the distal end, the upward motion mechanically forcing the deployable element from the stored orientation to the deployed orientation; and a second vehicle receiving member rotatably coupled to the base and having proximal and distal ends, the proximal end of the second vehicle receiving member being coupled via a hinged coupler to the proximal end of the first vehicle receiving member, and the first vehicle receiving member being configured to receive the applied force at the proximal end thereof via the hinged coupler responsive to the vehicle contacting the second vehicle receiving member.

* * * * *